US009494290B2

(12) United States Patent
Sakashita

(10) Patent No.: US 9,494,290 B2
(45) Date of Patent: Nov. 15, 2016

(54) VEHICLE LAMP

(75) Inventor: Kazuhisa Sakashita, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 600 days.

(21) Appl. No.: 13/443,322

(22) Filed: Apr. 10, 2012

(65) Prior Publication Data

US 2012/0262936 A1 Oct. 18, 2012

(30) Foreign Application Priority Data

Apr. 12, 2011 (JP) ..... 2011-088004

(51) Int. Cl.
*F21S 8/10* (2006.01)

(52) U.S. Cl.
CPC ..... *F21S 48/215* (2013.01); *F21S 48/2212* (2013.01); *F21S 48/234* (2013.01); *F21S 48/24* (2013.01)

(58) Field of Classification Search
CPC ..... F21S 48/215; F21S 48/2212; F21S 48/234; F21S 48/24
USPC ..... 362/517–520
See application file for complete search history.

(56) References Cited

U.S. PATENT DOCUMENTS

| | | | | |
|---|---|---|---|---|
| 7,416,324 | B1 * | 8/2008 | Tessnow et al. | 362/545 |
| 7,461,960 | B2 | 12/2008 | Opolka et al. | |
| 2007/0263390 | A1 | 11/2007 | Timinger et al. | |

FOREIGN PATENT DOCUMENTS

| | | | | |
|---|---|---|---|---|
| CN | 100549505 | C | | 10/2009 |
| JP | 9-231809 | A | | 9/1997 |
| JP | 2007-027107 | A | | 2/2007 |
| JP | 2007-207507 | A | | 8/2007 |
| JP | 2007207507 | A | * | 8/2007 |

OTHER PUBLICATIONS

English Patent Abstract of JP 9-231809, Publication Date: Sep. 5, 1997 (1 Page).
Office Action in counterpart Chinese Patent Application No. 201210107314.2 issued Dec. 24, 2013 (16 pages).
Notification of Reasons for Refusal issued in corresponding Japanese Application No. 2011-088004, mailed on Nov. 25, 2014 (8 pages).

* cited by examiner

*Primary Examiner* — Anne Hines
(74) *Attorney, Agent, or Firm* — Osha Liang LLP

(57) ABSTRACT

A vehicle lamp includes a semiconductor light source disposed on an optical axis of the vehicle lamp, a reflector having a plurality of reflective surfaces radially divided about the optical axis and boundary portions formed between two of the reflective surfaces adjacent to each other, and a lens cap that covers the front side of the light source. The lens cap includes a side lens portion that projects laterally emitted light from the light source toward the reflector. The laterally emitted light makes an angle with the optical axis that is at least a predetermined angle. The side lens portion is divided into at least two lens elements in a circumferential direction around the optical axis, and refracts the laterally emitted light so that the laterally emitted light avoids the boundary portions.

18 Claims, 7 Drawing Sheets

VEHICLE LAMP

CROSS REFERENCE TO RELATED APPLICATION(S)

The present disclosure relates to the subject matter contained in Japanese Patent Application No. 2011-088004 filed on Apr. 12, 2011, which are incorporated herein by reference in its entirety.

FIELD

The present invention relates to a vehicle lamp.

BACKGROUND

Various structures are proposed as the structure of a lamp. A structure, which includes a light source and a reflector reflecting light emitted from the light source forward, is proposed in JP-A-9-231809 and the like as one vehicle lamp. In a vehicle lamp disclosed in JP-A-9-231809, reflective surfaces of the reflector are radially divided about an optical axis and the appearance of the lamp is improved when lighting.

However, if the reflective surfaces of the reflector are radially divided as in JP-A-9-231809, light, which is emitted from the light source and projected to a gap between the adjacent reflective surfaces, is not reflected in an intended direction by the reflective surfaces. Accordingly, it is not possible to effectively use the light emitted from the light source, so that it is not possible to sufficiently improve the usage efficiency of the light.

SUMMARY

One or more embodiments of the present invention provides a vehicle lamp with a novel appearance which has high usage efficiency of light and of which a reflective surface of a reflector is radially divided about an optical axis.

According to one or more embodiments of the present invention, a vehicle lamp includes a semiconductor light source that is disposed on an optical axis of the vehicle lamp, a reflector that includes a plurality of reflective surfaces radially divided about the optical axis and boundary portions formed between the two adjacent reflective surfaces, and a lens cap that covers the front side of the light source, wherein the lens cap includes a side lens portion projecting laterally emitted light, of which a solid angle about the optical axis is equal to or larger than a predetermined angle, of light, which is emitted forward from the light source, toward the reflector, and the side lens portion is divided into at least two lens elements in a circumferential direction around the optical axis, and refracts the laterally emitted light so that the laterally emitted light avoids the boundary portions.

According to one or more embodiments of the present invention, the lens cap includes a front lens portion that significantly diffuses forward emitted light, of which a solid angle about the optical axis is smaller than a predetermined angle, of the light, which is emitted forward from the light source, in a horizontal direction as compared to in a vertical direction and projects the forward emitted light forward.

According to one or more embodiments of the present invention, the side lens portion is a condensing lens that condenses the laterally emitted light in a direction perpendicular to the optical axis.

According to one or more embodiments of the present invention, the boundary portions are provided with ribs that protrude forward from the reflector.

According to one or more embodiments of the present invention, the lens cap and/or the reflector are fixed to a substrate on which the light source is mounted.

According to the vehicle lamp according to one or more embodiments of the invention, light, which would be directed to the boundary portions of the reflective surfaces, and not emitted forward, and would normally reduce the usage efficiency of light, is refracted toward the reflective surfaces by the divided side lens portion. Accordingly, it is possible to provide a vehicle lamp with a novel appearance that does not reduce the light usage efficiency even though boundary portions are formed at a reflector.

BRIEF DESCRIPTION OF THE DRAWINGS

Drawings and the associated descriptions are provided to illustrate embodiments of the invention and should not limit the scope of the invention.

DETAILED DESCRIPTION OF THE EMBODIMENTS

Embodiments of the present invention will be described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Entire Structure

Figure 1:
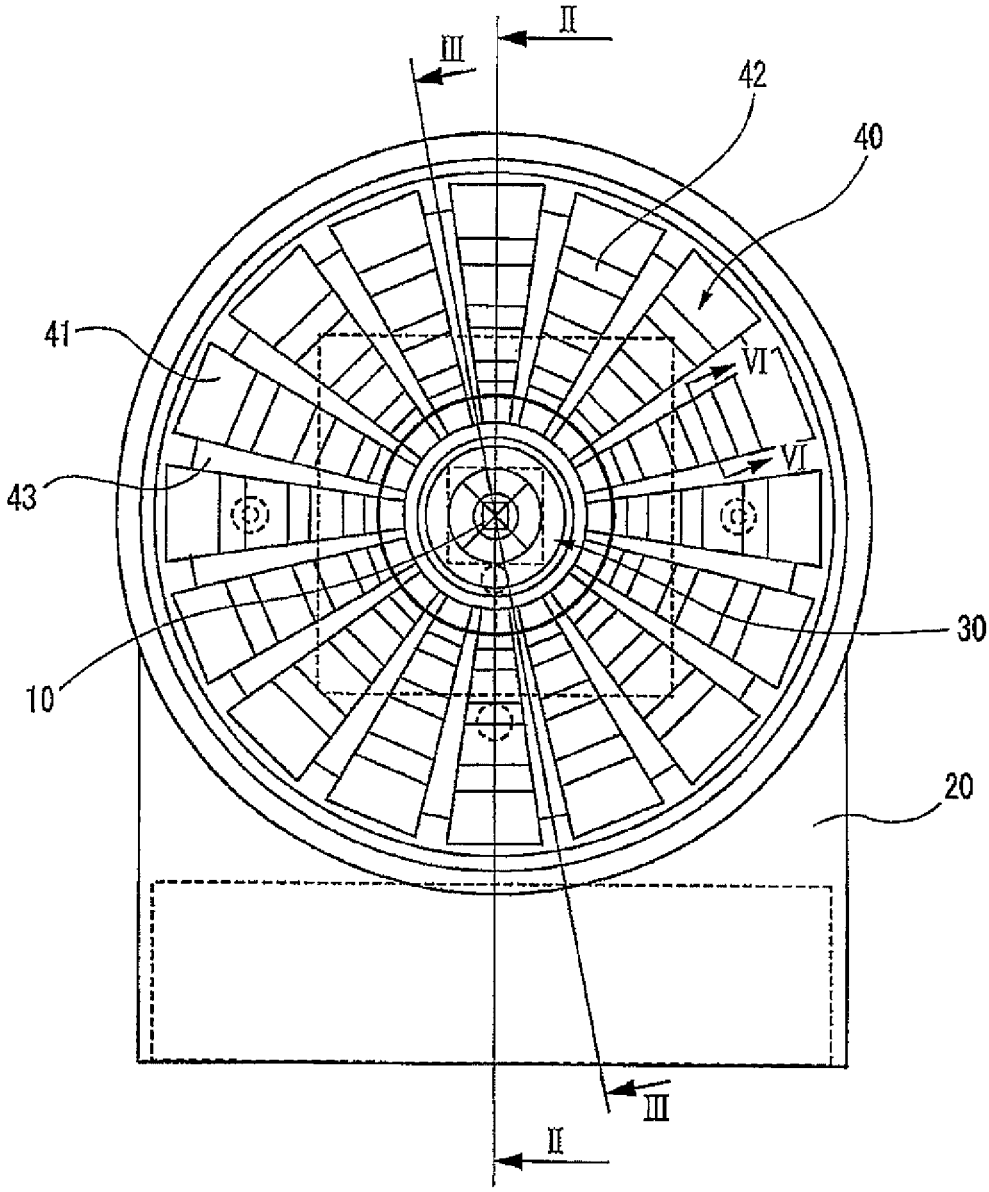
FIG. 1 is a front view of a vehicle lamp according to one or more embodiments of the invention.
Figure 2:
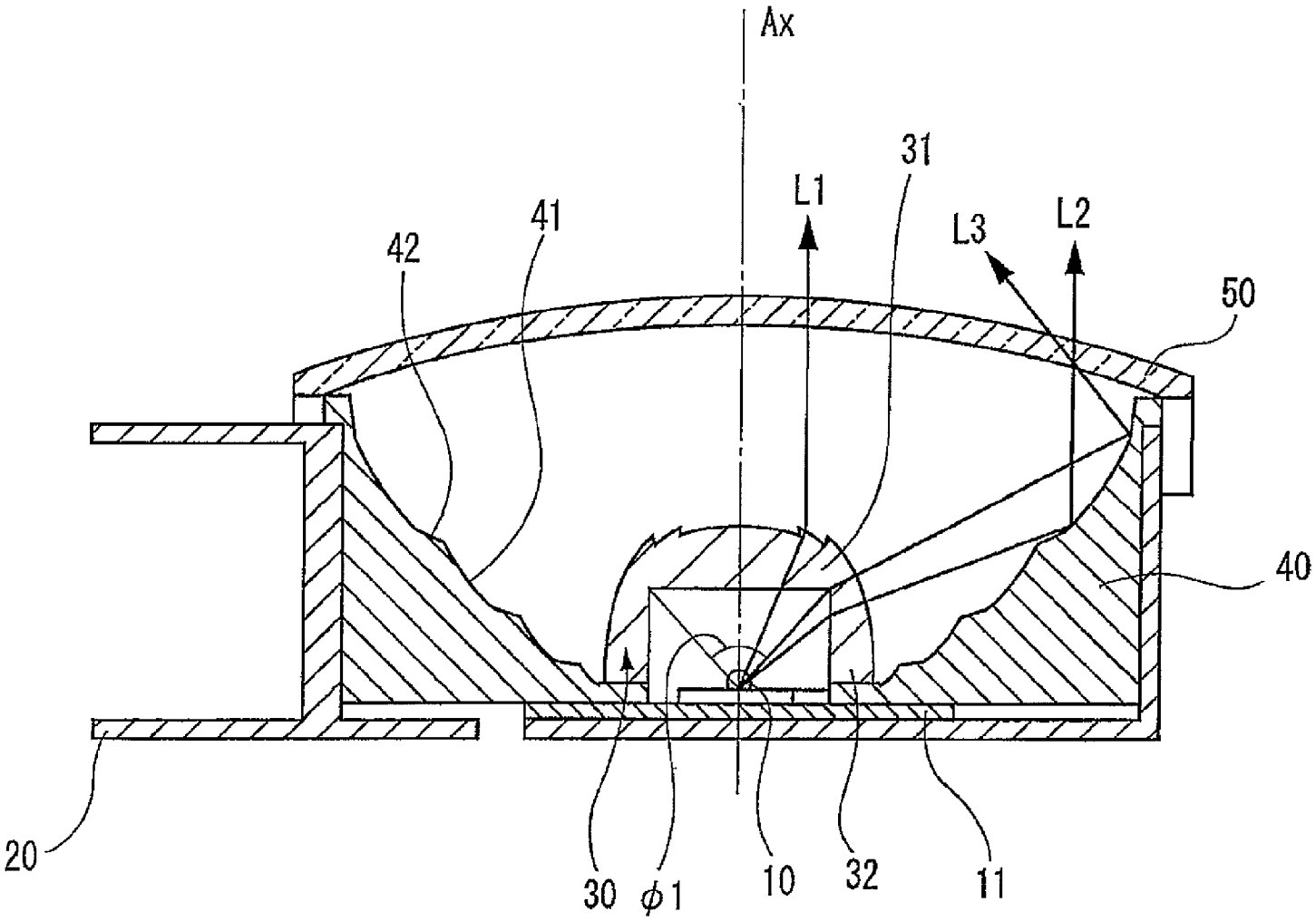
FIG. 2 is a cross-sectional view taken along a line II-II of FIG. 1.
Figure 3:
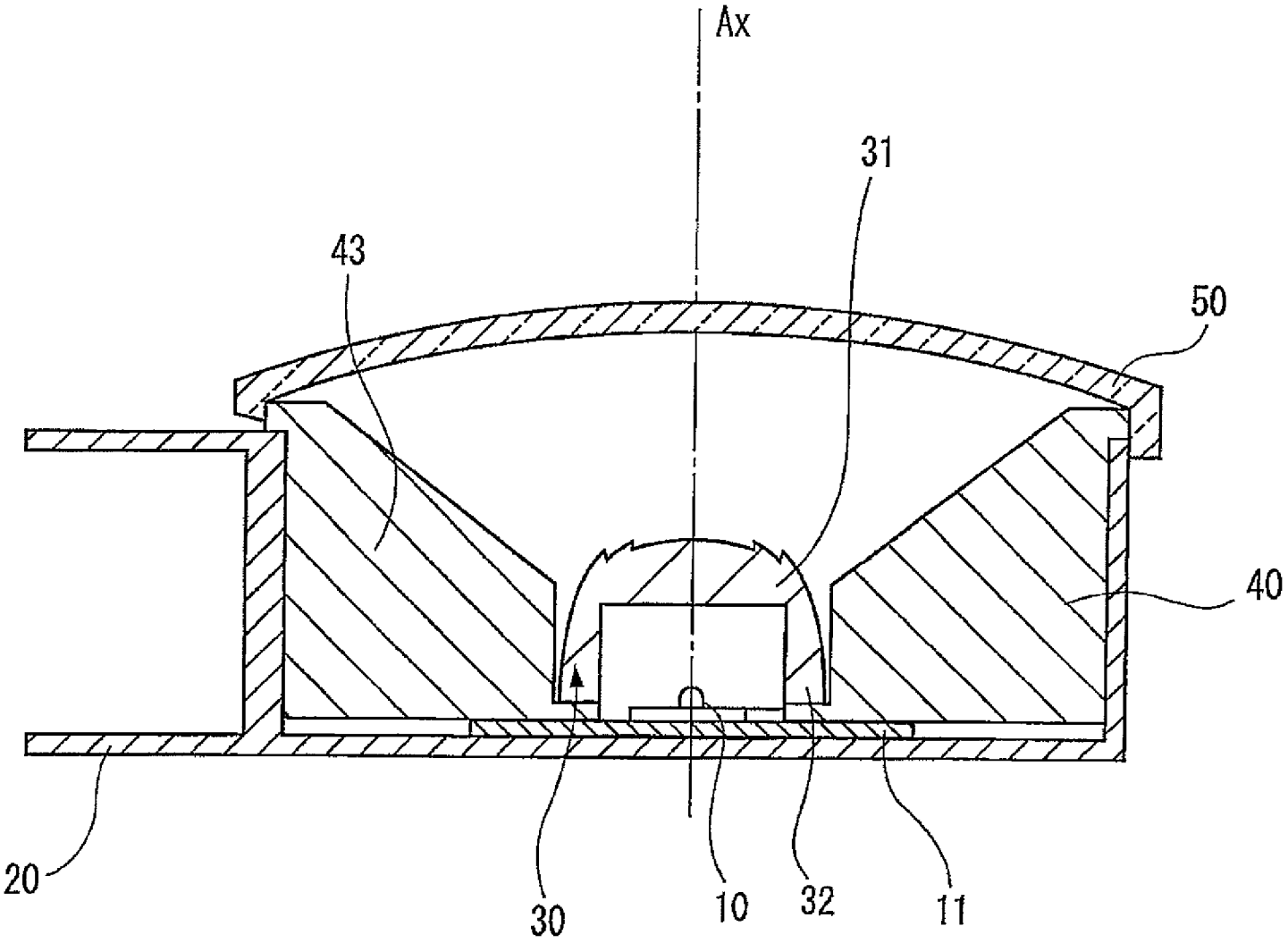
FIG. 3 is a cross-sectional view taken along a line III-III of FIG. 1.

FIG. 1 is a front view of a vehicle lamp 1 according to one or more embodiments of the invention, FIG. 2 is a cross-sectional view taken along a line II-II of FIG. 1, and FIG. 3 is a cross-sectional view taken along a line III-III of FIG. 1. Meanwhile, in the following description, the front side means the front side of the vehicle lamp 1 and means the left side in FIGS. 2 and 3.

As shown in FIG. 1, the vehicle lamp 1 includes a semiconductor light source 10 such as a LED that is disposed on an optical axis Ax (see FIG. 2) of the vehicle lamp 1, a frame 20, a lens cap 30 that covers the front side of the semiconductor light source 10, and a reflector 40 that reflects light emitted from the semiconductor light source 10 forward.

As shown in FIG. 2, the semiconductor light source 10 is fixed on a substrate 11 and the reflector 40 is also fixed to the substrate 11 likewise. The substrate 11 is fixed to the frame 20. It is possible to align the semiconductor light source 10 with the reflector 40 with high accuracy by disposing the semiconductor light source 10 and the reflector 40 on the common substrate 11. The lens cap 30 may be fixed on the reflector 40 as shown in FIG. 2, and may be fixed on the substrate 11.

Returning to FIG. 1, the reflector 40 includes a plurality of (16 in the embodiments shown in the drawings) reflective surfaces 41 that are divided about the optical axis Ax of the vehicle lamp 1. These reflective surfaces 41 are formed as a paraboloid of revolution about the optical axis Ax of the vehicle lamp 1 as a whole. The reflective surfaces 41, which have the shape of a paraboloid of revolution, reflect light, which is emitted from the semiconductor light source 10, mainly in the form of parallel light that is parallel to the optical axis Ax.

Further, as shown in FIGS. 1 and 3, ribs 43, which protrude forward from the reflector 40, are formed at boundary portions formed between the respective reflective surfaces 41 in the circumferential direction around the optical axis Ax. Accordingly, the designability of the vehicle lamp 1 is improved and the strength of the reflector 40 is improved.

The lens cap 30 is a translucent member where a front lens portion 31 positioned on the front side of the semiconductor light source 10 and a side lens portion 32 positioned on the side of the semiconductor light source 10 are formed integrally with each other as shown in FIG. 2.

The front lens portion 31 of the lens cap 30 is disposed at a position where forward emitted light L1, of which a solid angle about the optical axis Ax is smaller than a predetermined angle Φ1, of the light emitted from the semiconductor light source 10 enters, and is formed so as to significantly diffuse the forward emitted light L1 in the horizontal direction as compared to in the vertical direction and project the forward emitted light L1 forward.

Further, the side lens portion 32 of the lens cap 30 is disposed at a position where laterally emitted light L2, of which a solid angle about the optical axis Ax is equal to or larger than a predetermined angle Φ1, of the light emitted from the semiconductor light source 10 enters, and is formed so as to project the laterally emitted light L2 toward the reflective surfaces 41 of the reflector 40.

Figure 4:
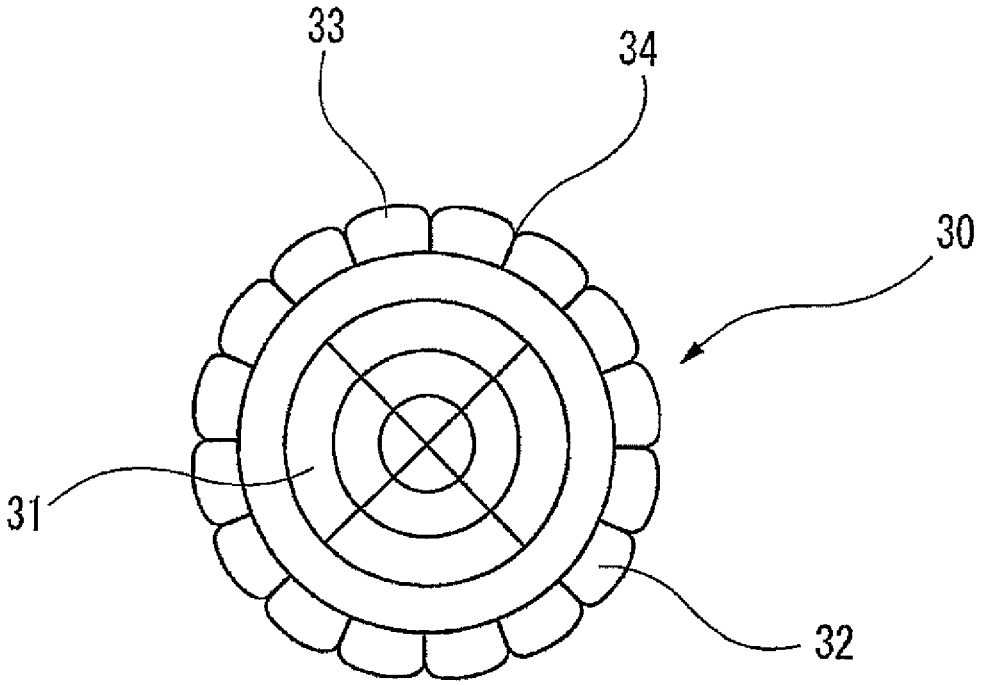
FIG. 4 is a front view of a lens cap of the vehicle lamp shown in FIG. 1.

As enlarged and shown in FIGS. 1 and 4, the side lens portion 32 is divided into a plurality of (16 in the embodiments shown in the drawings) lens elements 33 in the circumferential direction around the optical axis Ax so as to correspond to the respective reflective surfaces. Furthermore, the side lens portion 32 refracts the laterally emitted light L2 so that the laterally emitted light L2 avoids the ribs 43 of the reflector 40, and projects the light to only the reflective surfaces 41 of the reflector 40.

Figure 5:
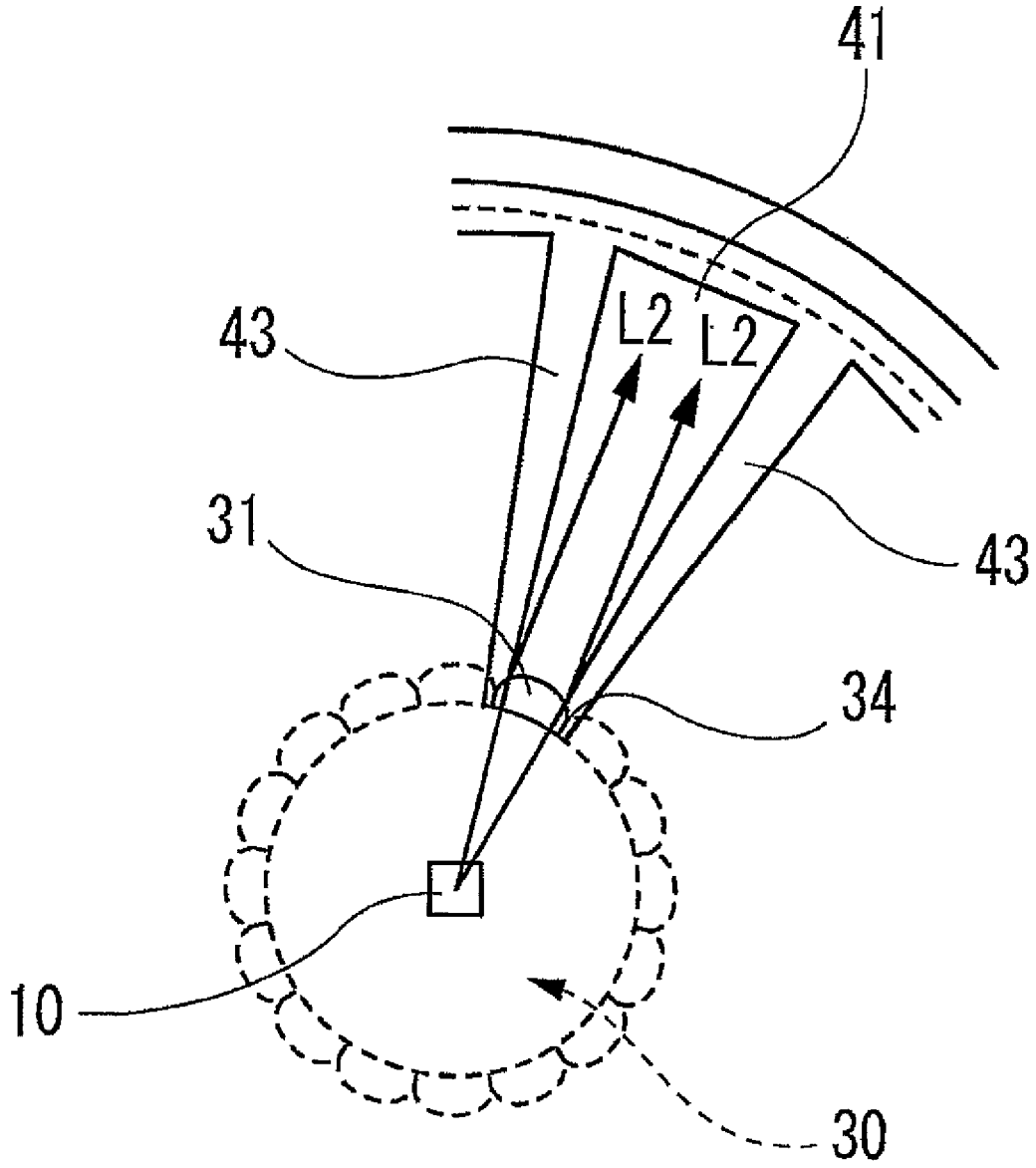
FIG. 5 is a partially enlarged view of the vehicle lamp shown in FIG. 1.

The side lens portion 32 may include the lens elements 33 that are formed of a plurality of convex lenses, and steps 34 that are formed between these lens elements 33. It is possible to refract the laterally emitted light L2 so that the laterally emitted light L2 avoids the ribs 43, by disposing the side lens portion 32 so that the lens elements 33 are positioned at regions corresponding to the reflective surfaces 41 of the reflector 40 and the steps 34 are positioned at regions corresponding to the ribs 43 of the reflector 40 as shown in FIG. 5. Meanwhile, the curvature of the lens element 33 is exaggeratedly shown in FIG. 5.

Operation

According to the vehicle lamp 1 having this structure, as shown in FIG. 2, the forward emitted light L1, which is emitted forward from the semiconductor light source 10 and of which the solid angle is smaller than Φ1, is diffused and projected forward by the front lens portion 31. Further, the laterally emitted light L2, which is emitted laterally and of which the solid angle is equal to or larger than Φ1, is refracted by the side lens portion 32 so as to be projected to only the reflective surfaces 41, is reflected by the reflective surfaces 41, is reflected and diffused by the reflective surfaces 41, and is projected forward.

As described above, the light emitted from the semiconductor light source 10 is diffused projected forward by the front lens portion 31 positioned at the center of the vehicle lamp 1 and the reflective surfaces 41 of the reflector 40 radially disposed around the lens cap 30, so that both the front lens portion and the reflective surfaces have different appearances. Accordingly, it is possible to provide a vehicle lamp 1 having a novel design.

Furthermore, since light, which is to be originally directed to the ribs 43, of the laterally emitted light L2 emitted from the semiconductor light source 10 is refracted by the side lens portion 32 so as to be directed to the reflective surfaces 41 as shown in FIG. 5, it is possible to prevent light, which is emitted to the ribs 43 and is not projected forward, from being generated and to effectively use light emitted from the semiconductor light source 10. Accordingly, it is possible to provide a vehicle lamp 1 having high illuminance.

Moreover, it is preferable that the side lens portion 32 be a condensing lens condensing the laterally emitted light L2 in a direction perpendicular to the optical axis Ax (on the reflective surfaces 41). If the light emitted from the side lens portion 32 is condensed on the reflective surfaces 41, that is, the light projected forward is refracted in the direction perpendicular to the optical axis Ax as described above, the reflective surfaces 41 of the reflector 40 do not need to be formed up to the front side. Accordingly, it is possible to reduce the depth of the reflector 40.

Further, if the front lens portion 31, which is a condensing lens, is also formed of a Fresnel lens as shown in FIG. 1, it is possible to reduce the depth of the front lens portion 31 while maintaining a desired refractive index. Accordingly, it is possible to mount the vehicle lamp 1 according to one or more embodiments even on a vehicle having a small mounting space.

Furthermore, if the reflective surfaces 41 are formed so as to reflect the laterally emitted light L2 in the form of parallel light parallel to the optical axis Ax and diffuse a part L3 of the laterally emitted light near the optical axis Ax, it is possible to improve the visibility of the vehicle lamp 1. Accordingly, this is preferable.

Figure 6:
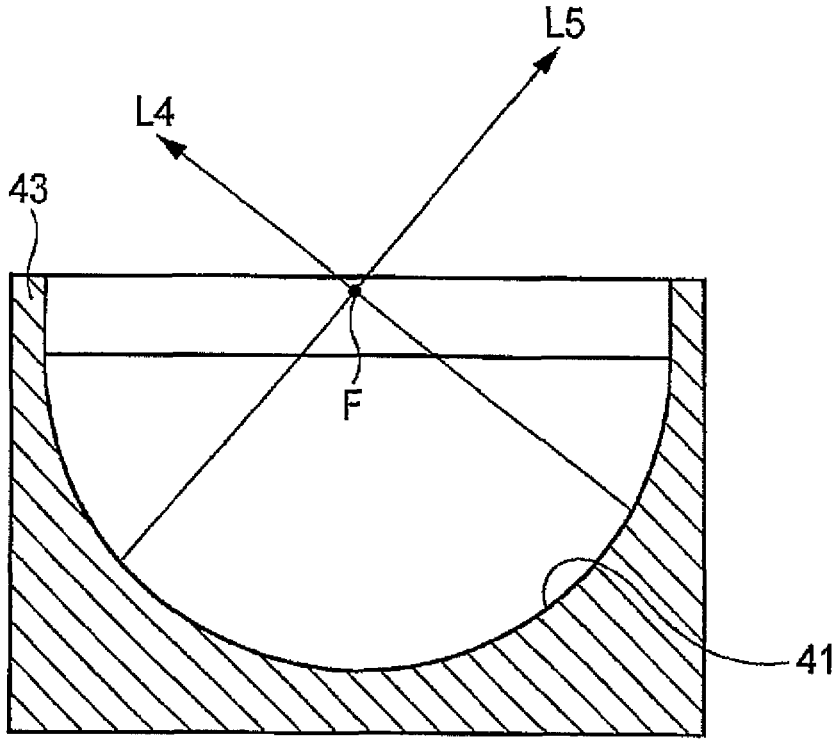
FIG. 6 is a cross-sectional view taken along a line VI-VI of FIG. 1.

Moreover, the cross-section of each of the reflective surfaces 41 of the reflector 40 in the circumferential direction may be formed of a concave surface recessed toward the paraboloid of revolution so that reflected lights L4 and L5 are diffused forward after being condensed once as shown in FIG. 6, that is, so-called "cross diffusion" occurs when the laterally emitted light L2 is reflected. If the reflective surfaces 41 are formed so as to have the shape shown in the drawing, the light reflected by the reflective surfaces 41 is projected forward without being blocked by the ribs 43. Accordingly, it is possible to provide a vehicle lamp 1 having high illuminance.

Further, the reflective surfaces 41 of the reflector 40 are divided in the shape of concentric circles, which have a center on the optical axis Ax, by circumferential steps 42 that are formed in the circumferential direction around the optical axis Ax. Since the reflective surfaces 41 are divided in the shape of concentric circles as described above, it is possible to form a plurality of light-emitting surfaces that emit light in the shape of concentric circles. Accordingly, it is possible to improve the designability of the vehicle lamp 1.

Furthermore, if the circumferential steps 42 are formed parallel to the light refracted from the side lens portion 32, it is possible to make the laterally emitted light L2, which is emitted from the side lens portion 32, reach the reflective surfaces 41 without blocking the laterally emitted light L2 by the circumferential steps 42. Accordingly, it is possible to improve the use efficiency of the light of the vehicle lamp Moreover, it is preferable that the respective reflective surfaces 41, which are divided by the circumferential steps 42, of the reflective surfaces 41 of the reflector 40, which are formed as a paraboloid of revolution about the optical axis Ax of the vehicle lamp 1 as a whole, be formed by connecting a plurality of paraboloids having different focal lengths. That is, it is preferable that the position of the focus of the reflective surface 41 be set to the semiconductor light source 10 or in the vicinity of the semiconductor light source 10 and the reflective surface 41 distant from the semiconductor light source 10 be formed in the shape of a paraboloid having a larger focal length. If the reflective surfaces 41 are formed as described above, it is possible to project the light, which is emitted from the light source 10, forward while increasing a light-emitting area without increasing the depth of the vehicle lamp 1, and to emit light in the shape of a plurality of circular rings that are discrete around the optical axis Ax in the radial direction of the optical axis Ax. Accordingly, it is possible to improve the appearance of the vehicle lamp 1.

Further, the front lens portion 31 may be divided into a plurality of lens elements and the direction of the light projected from the respective lens elements may be changed. For example, if the shapes of the respective lens elements of the front lens portion 31 are set to be different from each other so that light is significantly diffused in the horizontal direction as compared to in the vertical direction, it is possible to form the vehicle lamp 1 that can illuminate a large area in the horizontal direction.

Furthermore, as shown in FIGS. 2 and 3, a lens cover 50 may be provided on the front surface of the reflector 40 so that the light, which is projected forward from the front lens portion 31 of the lens cap 30 and the reflective surfaces 41 of the reflector 40, is diffused and projected forward.

Moreover, the respective reflective surfaces 41 of the reflector 40 may be formed so that light reflected by the respective reflective surfaces 41 forms light emission patterns different from each other. For example, if reflective surfaces 41 extending in the vertical direction are formed so that light reflected by the reflective surfaces 41 becomes parallel light substantially parallel to the optical axis Ax and reflective surfaces 41 extending in the horizontal direction are formed so that light reflected by the reflective surfaces 41 becomes light diffused in the horizontal direction, it is possible to improve visibility without giving glare to an oncoming vehicle and the like. Accordingly, this is preferable.

Modification

A case where the ribs 43 are formed at the boundary portions formed between the plurality of radially divided reflective surfaces 41 has been described above. However, one or more embodiments of the invention may also have the following modification.

Figure 7:
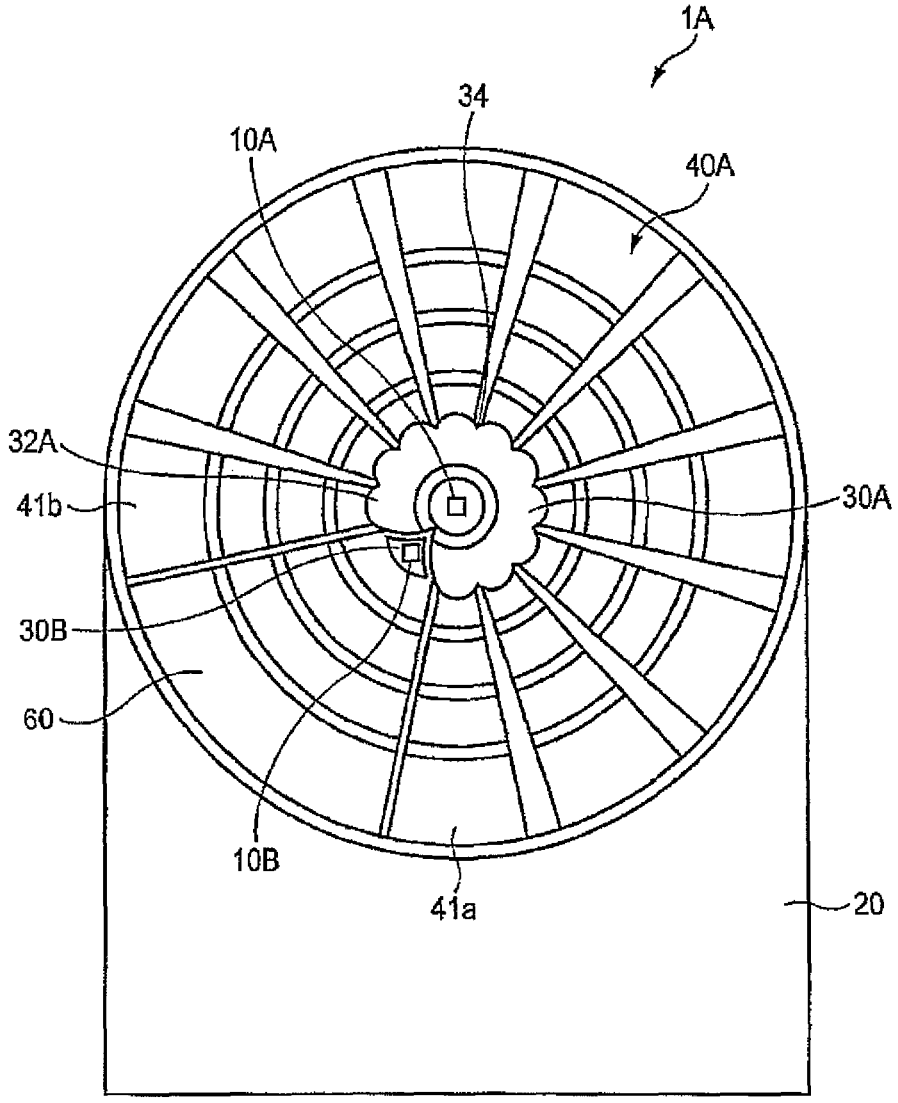
FIG. 7 is a front view of a vehicle lamp according to one or more embodiments of the invention.

FIG. 7 is a front view of a vehicle lamp 1A according to one or more embodiments of the invention.

Even in this modification, as in the above-mentioned embodiments, a vehicle lamp includes a first semiconductor light source 10A, a frame 20, a first lens cap 30A that covers the front side of the first semiconductor light source 10A, and a reflector 40A that includes first reflective surfaces 41 reflecting light emitted from the first semiconductor light source 10A forward. The first reflective surfaces 41 are radially divided about an optical axis Ax.

A second light source 10B, second reflective surfaces 60 that reflect light emitted from the second light source 10B forward, and a second lens cap 30B that projects light emitted from the second light source 10B to the front side and the second reflective surfaces 60 are disposed at a boundary portion formed between two specific reflective surfaces 41*a* and 41*b* of the radially divided reflector 40A.

The shape of a side lens portion 32A of the first lens cap 30A of this modification is formed so that light, which is directed to the second reflective surfaces 60, of light emitted laterally from the first semiconductor light source 10A is refracted and projected to the first reflective surfaces 41. Meanwhile, this modification is the same as the above-mentioned embodiments in that steps 34 are formed at the positions corresponding to ribs 43 so that the light emitted laterally from the first semiconductor light source 10A is refracted to avoid the ribs 43.

The reflector 40A is radially sectioned into the first reflective surfaces 41 and the second reflective surfaces 60 as described above. For example, a stop indicator may be formed by the first reflective surfaces 41 and a turn indicator may be formed by the second reflective surfaces. It is possible to provide a vehicle lamp with a further novel appearance by making the respective reflective surfaces emit light by separate light sources as described above.

Because the laterally emitted light L2, which is emitted from the first semiconductor light source 10A, is refracted by the side lens portion 32A of the first lens cap 30A so as to avoid the second reflective surfaces 60 not using the light of the first semiconductor light source 10A and light is concentrated on the first reflective surfaces 41, it is possible to improve the use efficiency of light even in this case.

The invention has been described above with reference to embodiments of the invention. However, the technical scope of the invention is not limited to the scope described in the above-mentioned embodiments. It is apparent to those skilled in the art that the embodiments may be changed or modified in various ways.

For example, the reflector 40A formed in a circular shape has been shown in the embodiments shown in FIG. 1. However, the invention is not limited to this shape, and may be applied to various shapes such as a rectangular shape. Further, a case where the reflective surfaces 41 are divided equally into 16 pieces has been described. However, the number of the divided pieces is not limited to 16 and the reflective surfaces may not be divided equally.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicle lamp comprising:

a semiconductor light source disposed on an optical axis of the vehicle lamp;

a reflector comprising a plurality of reflective surfaces radially divided about the optical axis and boundary portions formed between two of the reflective surfaces adjacent to each other; and a lens cap that covers the front side of the light source, wherein the lens cap comprises a side lens portion that projects laterally emitted light from the light source toward the reflector, wherein the laterally emitted light makes an angle with the optical axis that is at least a predetermined angle, and wherein the side lens portion is divided into at least two lens elements in a circumferential direction around the optical axis, and refracts the laterally emitted light so that the laterally emitted light avoids the boundary portions.

2. The vehicle lamp according to claim 1, wherein the side lens portion is a condensing lens that condenses the laterally emitted light in a direction perpendicular to the optical axis.

3. The vehicle lamp according to claim 2, wherein the boundary portions are provided with ribs that protrude forward from the reflector.

4. The vehicle lamp according to claim 3, wherein at least one of the lens cap and the reflector is fixed to a substrate on which the light source is mounted.

5. The vehicle lamp according to claim 2, wherein at least one of the lens cap and the reflector is fixed to a substrate on which the light source is mounted.

6. The vehicle lamp according to claim 1, wherein the boundary portions are provided with ribs that protrude forward from the reflector.

7. The vehicle lamp according to claim 6, wherein at least one of the lens cap and the reflector is fixed to a substrate on which the light source is mounted.

8. The vehicle lamp according to claim 1, wherein at least one of the lens cap and the reflector is fixed to a substrate on which the light source is mounted.

9. The vehicle lamp according to claim 1, wherein the side lens portion refracts the laterally emitted light toward the reflective surfaces so that the laterally emitted light avoids the boundary portions.

10. A vehicle lamp comprising:

a semiconductor light source disposed on an optical axis of the vehicle lamp;

a reflector comprising a plurality of reflective surfaces radially divided about the optical axis and boundary portions formed between two of the reflective surfaces adjacent to each other; and a lens cap that covers the front side of the light source, wherein the lens cap comprises a side lens portion that projects laterally emitted light from the light source toward the reflector, wherein the laterally emitted light makes an angle with the optical axis that is at least a predetermined angle, and wherein the side lens portion is divided into at least two lens elements in a circumferential direction around the optical axis, and refracts the laterally emitted light so that the laterally emitted light avoids the boundary portions, wherein the lens cap further comprises a front lens portion that significantly diffuses forward emitted light emitted by the light source, in a horizontal direction as compared to in a vertical direction, wherein the forward emitted light makes an angle with the optical axis that is less than the predetermined angle, and wherein the front lens portion projects the forward emitted light forward.

11. The vehicle lamp according to claim 10, wherein the side lens portion is a condensing lens that condenses the laterally emitted light in a direction perpendicular to the optical axis.

12. The vehicle lamp according to claim 11, wherein the boundary portions are provided with ribs that protrude forward from the reflector.

13. The vehicle lamp according to claim 12, wherein at least one of the lens cap and the reflector is fixed to a substrate on which the light source is mounted.

14. The vehicle lamp according to claim 11, wherein at least one of the lens cap and the reflector is fixed to a substrate on which the light source is mounted.

15. The vehicle lamp according to claim 10, wherein the boundary portions are provided with ribs that protrude forward from the reflector.

16. The vehicle lamp according to claim 15, wherein at least one of the lens cap and the reflector is fixed to a substrate on which the light source is mounted.

17. The vehicle lamp according to claim 10, wherein at least one of the lens cap and the reflector is fixed to a substrate on which the light source is mounted.

18. A vehicle lamp comprising:

a semiconductor light source disposed on an optical axis of the vehicle lamp;

a reflector comprising a plurality of reflective surfaces radially divided about the optical axis and boundary portions formed between two of the reflective surfaces adjacent to each other; and a lens cap that covers the front side of the light source, wherein the lens cap comprises a side lens portion that projects laterally emitted light from the light source toward the reflector, wherein the laterally emitted light makes an angle with the optical axis that is at least a predetermined angle, wherein the side lens portion is divided into at least two lens elements in a circumferential direction around the optical axis, and refracts the laterally emitted light so that the laterally emitted light avoids the boundary portions, wherein the side lens portion comprises:

a plurality of lens elements divided in a circumferential direction around the optical axis, and a plurality of steps formed between the plurality of lens elements, wherein the side lens portion is disposed such that the lens elements are positioned at regions corresponding to the reflective surfaces of the reflector, and the steps are positioned at regions corresponding to the boundary portions of the reflector, and wherein the side lens portion refracts the laterally emitted light such that the laterally emitted light avoids the boundary portions.

* * * * *